US008028641B1

(12) United States Patent
Sly

(10) Patent No.: US 8,028,641 B1
(45) Date of Patent: Oct. 4, 2011

(54) CONVERTIBLE BENCH SEAT/PLATFORM FOR PONTOON BOATS

(76) Inventor: Paul Sly, Huffman, TX (US)

( * ) Notice: Subject to any disclaimer, the term of this patent is extended or adjusted under 35 U.S.C. 154(b) by 267 days.

(21) Appl. No.: 12/413,562

(22) Filed: Mar. 29, 2009

Related U.S. Application Data

(60) Provisional application No. 61/041,226, filed on Mar. 31, 2008.

(51) Int. Cl.

| | |
|---|---|
| ***B63B 17/00*** | (2006.01) |
| ***A47C 1/00*** | (2006.01) |
| ***A47C 1/12*** | (2006.01) |
| ***A47C 7/54*** | (2006.01) |
| ***A47C 13/00*** | (2006.01) |

(52) U.S. Cl. ..... 114/363; 114/362; 297/3; 297/93; 297/326; 297/344.1

(58) Field of Classification Search ..... 114/61.1, 114/292, 362–364; 182/33–34, 53–55, 97–99; 296/63, 65.01–69; 297/1–3, 14, 15, 92, 93, 297/283.1, 283.2, 325–329, 335, 344.1
See application file for complete search history.

(56) References Cited

U.S. PATENT DOCUMENTS

| | | | | |
|---|---|---|---|---|
| 3,862,456 | A * | 1/1975 | Fisher et al. | 114/363 |
| 4,030,436 | A * | 6/1977 | Stoberl | 114/363 |
| 4,442,787 | A * | 4/1984 | Curran et al. | 114/363 |
| 4,919,068 | A | 4/1990 | Lathers | |
| 4,926,783 | A | 5/1990 | Lathers | |
| 5,799,605 | A | 9/1998 | Huse | |
| 5,913,571 | A | 6/1999 | Dystra et al. | |
| 5,915,328 | A * | 6/1999 | Rowan | 114/362 |
| 5,975,610 | A * | 11/1999 | Tracy | 296/63 |
| 6,230,648 | B1 | 5/2001 | Davidson et al. | |
| 6,647,916 | B2 | 11/2003 | Neese et al. | |
| 6,715,440 | B2 | 4/2004 | Biedenweg et al. | |
| 6,739,280 | B2 | 5/2004 | Keller | |
| 6,789,494 | B2 | 9/2004 | Neese et al. | |
| 6,945,190 | B1 | 9/2005 | Frandsen | |
| 7,004,101 | B1 * | 2/2006 | Mardikian | 114/362 |
| 7,255,403 | B2 | 8/2007 | Butler | |
| 7,367,616 | B2 | 5/2008 | Summerford | |

* cited by examiner

*Primary Examiner* — Ajay Vasudeva
(74) *Attorney, Agent, or Firm* — Kenneth A. Roddy

(57) ABSTRACT

A convertible bench seat/platform that is pivotally connected to the deck of a pontoon boat and is movable between an inboard position adjacent to the boat side rail for use as a bench seat and an outboard position for use as a platform for fishing, sitting, diving and swimming or for search and rescue operations.

8 Claims, 14 Drawing Sheets

CONVERTIBLE BENCH SEAT/PLATFORM FOR PONTOON BOATS

CROSS REFERENCE TO RELATED APPLICATION

This application claims priority of U.S. Provisional Application Ser. No. 61/041,226, filed Mar. 31, 2008.

BACKGROUND OF THE INVENTION

1. Field of the Invention

This invention relates generally to seating and platform apparatus for flat deck boats, and more particularly to a convertible bench seat/platform that is pivotally connected to the deck of a pontoon boat that is movable between an inboard position on the deck adjacent to the boat side rail for use as a bench seat and an outboard position for use as a platform for fishing, sitting, diving and swimming or for search and rescue operations.

2. Background Art

Conventional pontoon boats are constructed with a deck positioned atop at least two pontoons and with seating surfaces and boat controls positioned inside a fence or railing substantially surrounding the deck. Typically, an outboard motor is connected to the stem of a pontoon boat for propelling the boat through the water and, in many models, generally L-shaped bench seats are secured to the railing. Traditionally, passengers on pontoon boats have rather limited access to the water surrounding them, typically through two or three narrow gates or doorways provided in the railing to allow entry and exit from the fenced deck area.

There exists a need in the pontoon boat art for providing passengers and crew of pontoon boats with improved access to the surrounding water for recreational activities such as fishing, sitting, diving and swimming, and also for search and rescue operations.

There are several patents that disclose various seating apparatus for boats, some of which are installed on flat deck boats, but none of which disclose the features of the present invention.

Lathers, U.S. Pat. No. 4,926,783 discloses a marine vehicle having a generally vertical wall and a recreational boat seat/sun deck having a second generally vertical wall extending generally perpendicular to the first wall, a first seat bottom member, a second seat bottom member, a hinge mechanism supporting the first seat bottom member for movement between a first position wherein the first seat bottom member extends generally horizontally from the first wall and a second position wherein the first seat bottom member extends generally vertically against the first wall, and a hinge mechanism supporting the second seat bottom member for movement between an operating position wherein the second seat bottom member extends generally horizontally from the second wall and is generally coplanar with the first seat bottom member when the first seat bottom member is in the first position, and a storage position wherein the second seat bottom member extends generally vertically against the second wall.

Lathers, U.S. Pat. No. 4,919,068 discloses a marine vehicle having a hull, a floor supported by the hull, and a convertible sofa-sleeper supported by the floor and including a seat bottom member having a forward end which is supported for movement between a horizontal position wherein the seat bottom member extends substantially horizontally, and a canted position wherein the seat bottom member is inclined upwardly toward the forward end.

Huse, U.S. Pat. No. 5,799,605 discloses an expandable seat and storage unit particularly adapted for use in a boat. The expandable seat has a base unit which defines a storage area. A frame is slidably mounted within the base and can slide with respect to the base to expand the length of the seat to form a bed. The frame is locked into the base by the back cushion of the seat. By removing the back cushion, the frame section can be slid out of the base and then the back cushion can be used along with the seat cushion to form a bed. The frame has side members which extend generally perpendicular from the side edges of the front face of the frame and ride in tracks formed in the base unit. The tracks are along the sides of the base unit and do not interfere with the storage area. Further, the tracks are formed integrally in the base unit to facilitate easy inexpensive manufacture and operation.

Dystra et al, U.S. Pat. No. 5,913,571 discloses a marine seating apparatus for a boat which has a one piece base to which is affixed a seat. The seat has a back portion divided into two parts, lower and upper, by a living hinge and a bench portion. In another embodiment a footrest portion is also included. In that embodiment, the footrest and bench portions are integrally formed and are separated by another living hinge. The seating apparatus is simply constructed of a sandwich material with outer layers comprising polyethylene and a core comprising foam. The seating apparatus may be moved between a bench style configuration and a lounge configuration.

Davidson et al, U.S. Pat. No. 6,230,648 discloses a motor boat having front and rear casting platforms and side platforms, a center console and oppositely facing, front and rear seat assemblies. Both seat assemblies can be opened to provide maximum seating when the boat is to be used for cruising. The front seat assembly may be collapsed to provide an extended front casting platform when it is desired to use the boat as a bay or striper boat. Both seat assemblies can be folded down to extend the front and rear casting platforms for use of the boat as a bass boat. When the seat assemblies are collapsed, supports are provided for a rigid back member forming part of each seat back and latches secure the seat backs in their collapsed position so that the rear surfaces of the rigid members provide stable extended casting platforms.

Neese et al, U.S. Pat. Nos. 6,647,916 and 6,789,494 disclose a fold out seat assembly is attached to a support structure having a substantially vertical mounting surface. The seat assembly comprises two sections: a backrest that is fixedly attached to the mounting surface above the seat assembly, and a seat unit that is movable from a vertical stored position against the mounting surface to a horizontal seating position the major portions of which are detachable from the mounting surface when not needed.

Biedenweg et al, U.S. Pat. No. 6,715,440 discloses a collapsible changing room for a pontoon boat having a rear entry stern gate. The collapsible changing room is formed in part by the passenger seat positioned adjacent the rear entry stern gate. An L-shaped bracket is rigidly secured to the rear portion of the seat and is further hingedly secured to a vertical fence member spaced from the seat back. The seat and the L-shaped support can be rotated upwardly away from the boat deck to a position in which the seat bottom is generally perpendicular to the boat deck. When the seat is rotated to this position, a curtain frame hingedly connected to the seat can be rotated from a stored position within the seat base to an extended position substantially parallel to the boat deck. Keller, U.S. Pat. No. 6,739,280 discloses a boat with swing chair seating which incorporates an inertia control swing pivot under the chairs which are pivotally mounted at and along the sidewalls of the boat, and are capable of being swung to a position outward of the sidewalls of the boat.

Frandsen, U.S. Pat. No. 6,945,190 discloses a combination seating and decking for an open bow boat that has a seat back system which includes a pair of seat benches for mounting to the floor of the open bow section of the boat. The seat backs are individually mounted to pivot from a vertical, seat back attitude, to a horizontal attitude covering over the open bow section and includes an arrangement for pivoting the seat backs that can be hydraulic, pneumatic or mechanical, that each involve an extending piston between a boat floor and at a location along a brace that is secured to a seat back side, extending at a right angle therefrom, with piston extension to provide seat back travel, providing a load bearing deck.

Butler, U.S. Pat. No. 7,255,403 discloses a take-down seat assembly for use in a watercraft having a deck. The seat assembly comprises a first portion and a second portion spaced from the first portion. First and second connector panels that are separable from and independent of the first and second portions interconnect the first and second portions. A plurality of locking tabs extend from each of the connector panels and are inserted into a plurality of slots defined in the portions to connect the connector panels to the first and second portions. A mounting bracket is attached to a base of each of the connector panels and perpendicularly extends from the connector panels to mount the connector panels to the deck thereby securing the first and second portions to the deck.

Summerford, U.S. Pat. No. 7,367,616 discloses a folding boat seat system mountable to a vertical mounting surface such as a bulkhead of the boat. The system includes a seat; a pair of guide followers extending from opposite sides of the seat; a pair of guides mountable to the mounting surface and configured for receiving the guide followers; a substantially U-shaped frame member having opposite ends pivotally mounted adjacent the guide followers; and a pair of bias struts, each having a first end pivotally mounted adjacent one of the guides and a second end pivotally mounted to support the seat.

SUMMARY OF THE INVENTION

The present invention overcomes the aforementioned problems and is distinguished over the prior art, and these patent in particular, by a convertible bench seat/platform that is pivotally connected to the deck of a boat and is movable between an inboard position on the deck for use as a bench seat and an outboard position for use as a platform. The apparatus has a seat frame assembly including a seat frame and a backrest frame. The seat frame has a generally rectangular vertical frame component with parallel spaced top and bottom ends, and laterally opposed ends, and a generally rectangular horizontal frame component defining a seat pan for receiving one or more seat cushions. The backrest frame has a generally rectangular upper member for receiving one or more backrest cushions and is pivotally connected with the vertical rear frame component to pivot relative thereto between a vertical upright position and a folded position generally parallel to the seat pan. The vertical frame component is hingedly connected with the deck of the boat closely adjacent to a side of the deck, and the seat frame assembly can be pivoted as a unit a between an inboard position adjacent to the boat side rail for use as a bench seat and an outboard position for use as a platform. In the inboard position, the vertical frame component and backrest frame in a vertical position is aligned with the side rail of the boat and the seat pan is disposed horizontally inward relative to the railing for use as a bench seat. In the outboard position, the seat pan is inverted and extends horizontally outward from a side of the boat for use as a platform for various purposes such as fishing, sitting, diving and swimming, and also for search and rescue operations.

DESCRIPTION OF THE PREFERRED EMBODIMENT

Figure 1A:
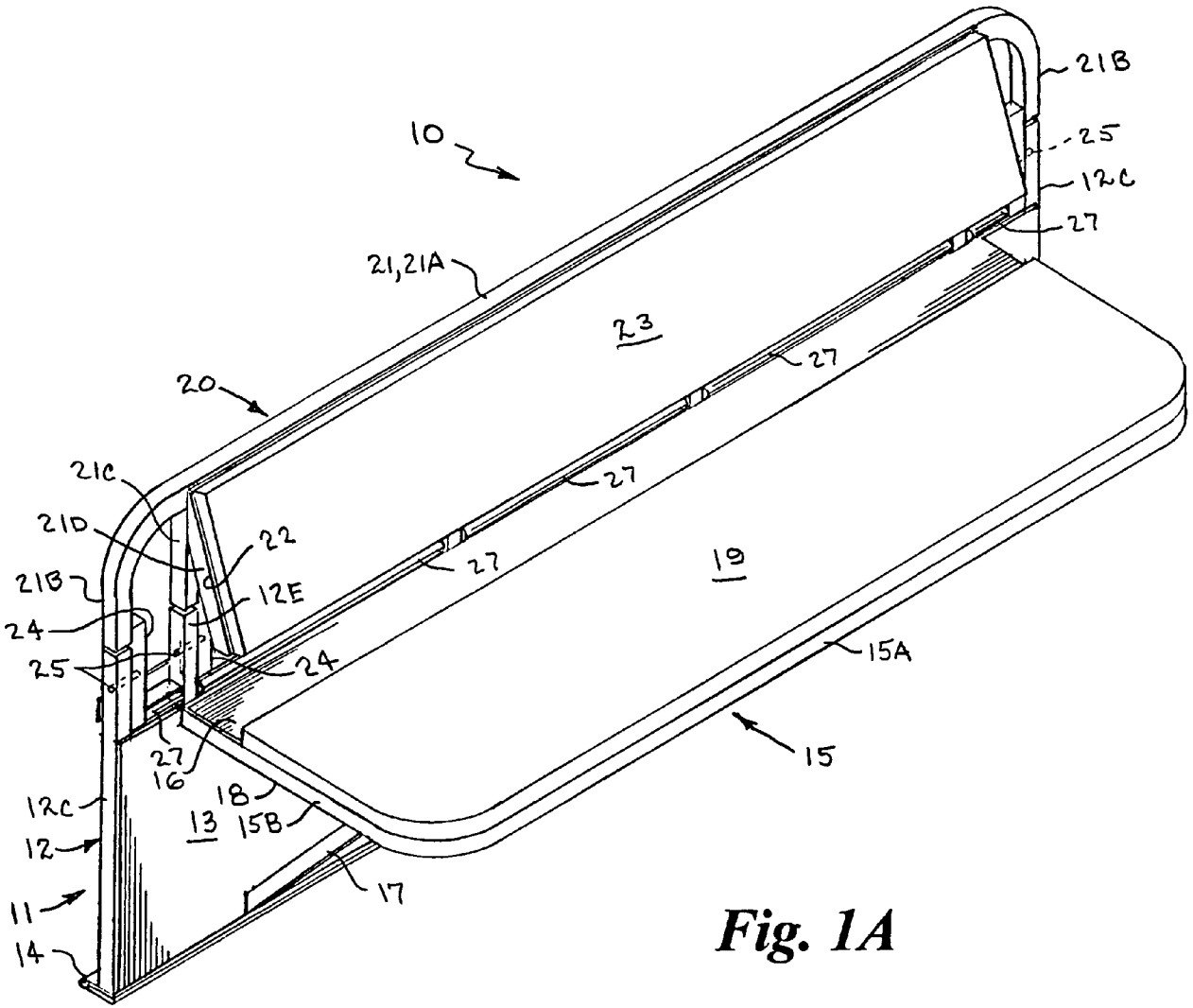
FIGS. 1A and 1B are isometric views, showing the convertible bench seat/platform apparatus in accordance with the present invention with the backrest in an upright raised position, shown from the front and back, respectively.

Referring now to the drawings by numerals of reference, there is shown in FIGS. 1A, 1B, 2A, 2B, and 3, a preferred convertible bench seat/platform apparatus 10 in accordance with the present invention. The bench seat/platform apparatus 10 has a foldable frame assembly which includes a seat frame 11 and a backrest frame 20, each constructed of bent tubing, such as square aluminum tubing, or other suitable rigid material.

The seat frame 11 has a generally rectangular vertical frame component 12 having parallel spaced top and bottom longitudinal members 12A, 12B and laterally opposed vertical end members 12C formed by rectangular tubing with shorter cross members 12D extending vertically between the top and bottom members in longitudinally spaced parallel relation, and a generally rectangular panel 13 formed of rigid material secured to one side of the vertical rear frame component. The panel 13 is not shown in FIG. 3, to more clearly show the show frame structure which would be obscured thereby. The laterally opposed vertical end members 12C extend a relatively short distance above the top longitudinal member 12A. A plurality of shorter vertical members 12E formed of rectangular tubing are secured at a bottom end to the top surface of the top longitudinal member 12A and extend vertically a relatively short distance therefrom in longitudinally spaced parallel relation. The first leg of an elongate hinge member 14 is secured to the bottom side of the bottom longitudinal member 12B.

Figure 5A:
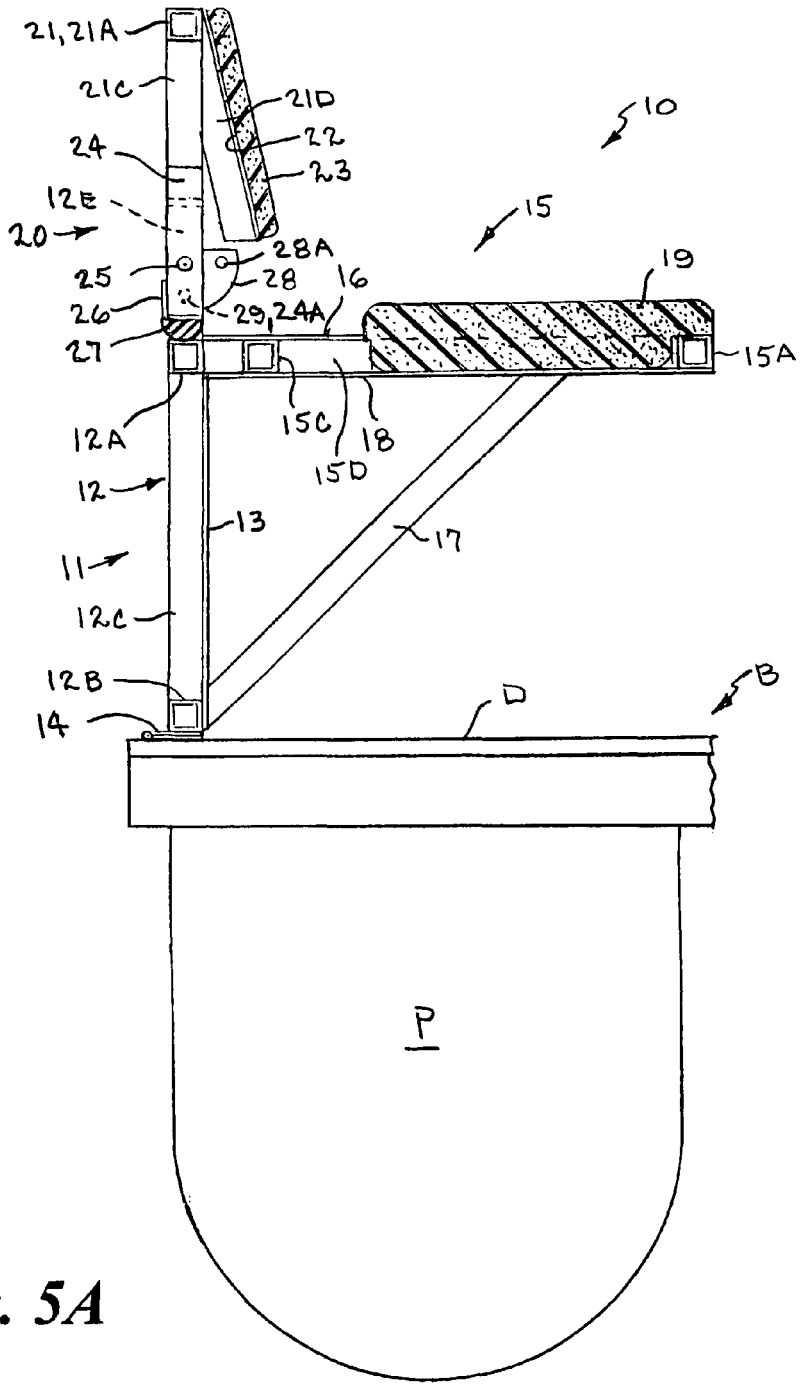
FIGS. 5A, 5B and 5C are cross sectional views of the convertible bench seat/platform apparatus taken along line 5-5 of FIG. 1B, showing it mounted on the deck and with the backrest in the upright position, the folded position, and the whole assembly pivoted over the side of the deck to serve as a platform, respectively.
Figure 5B:
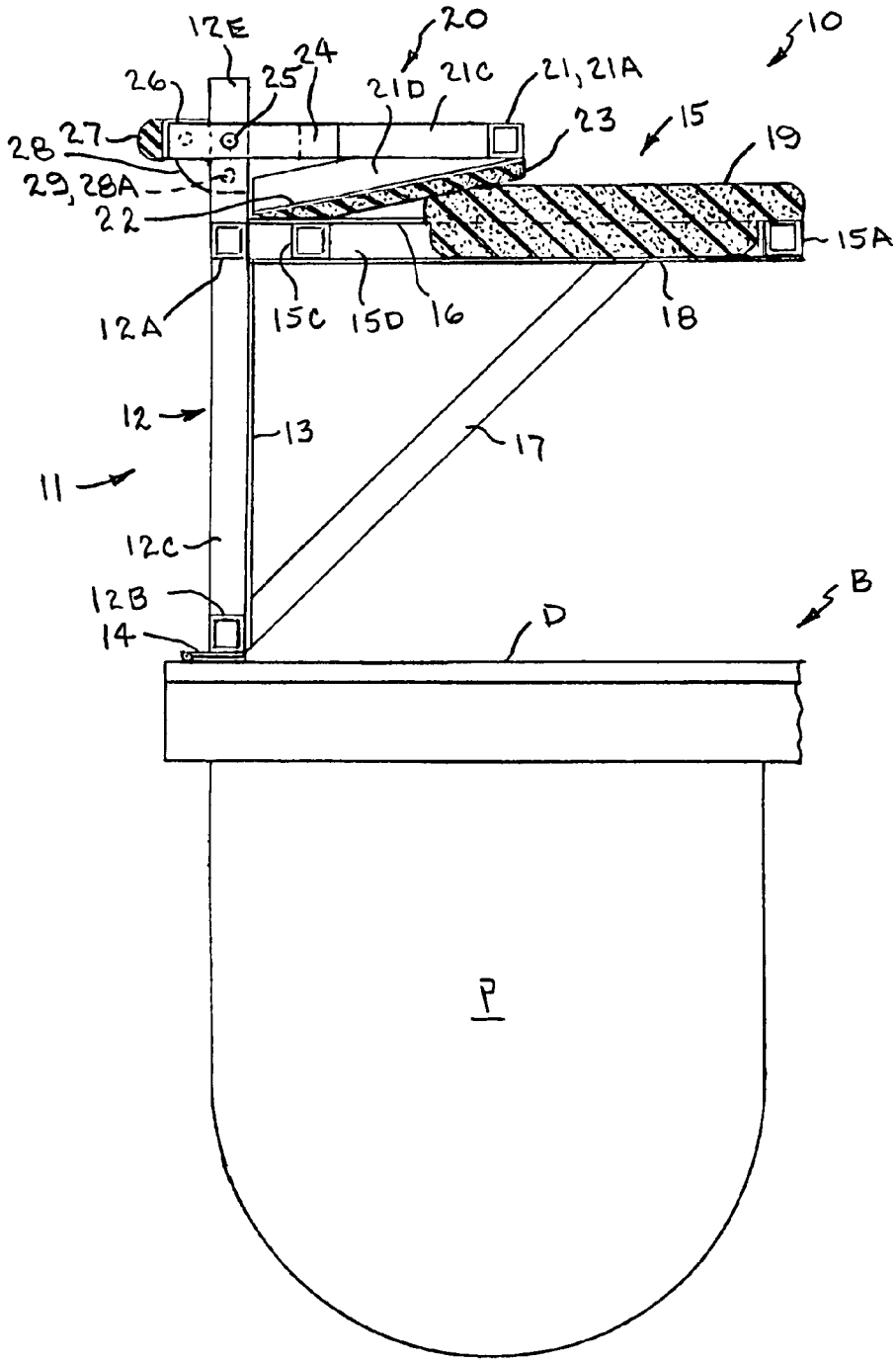
Figure 5C:
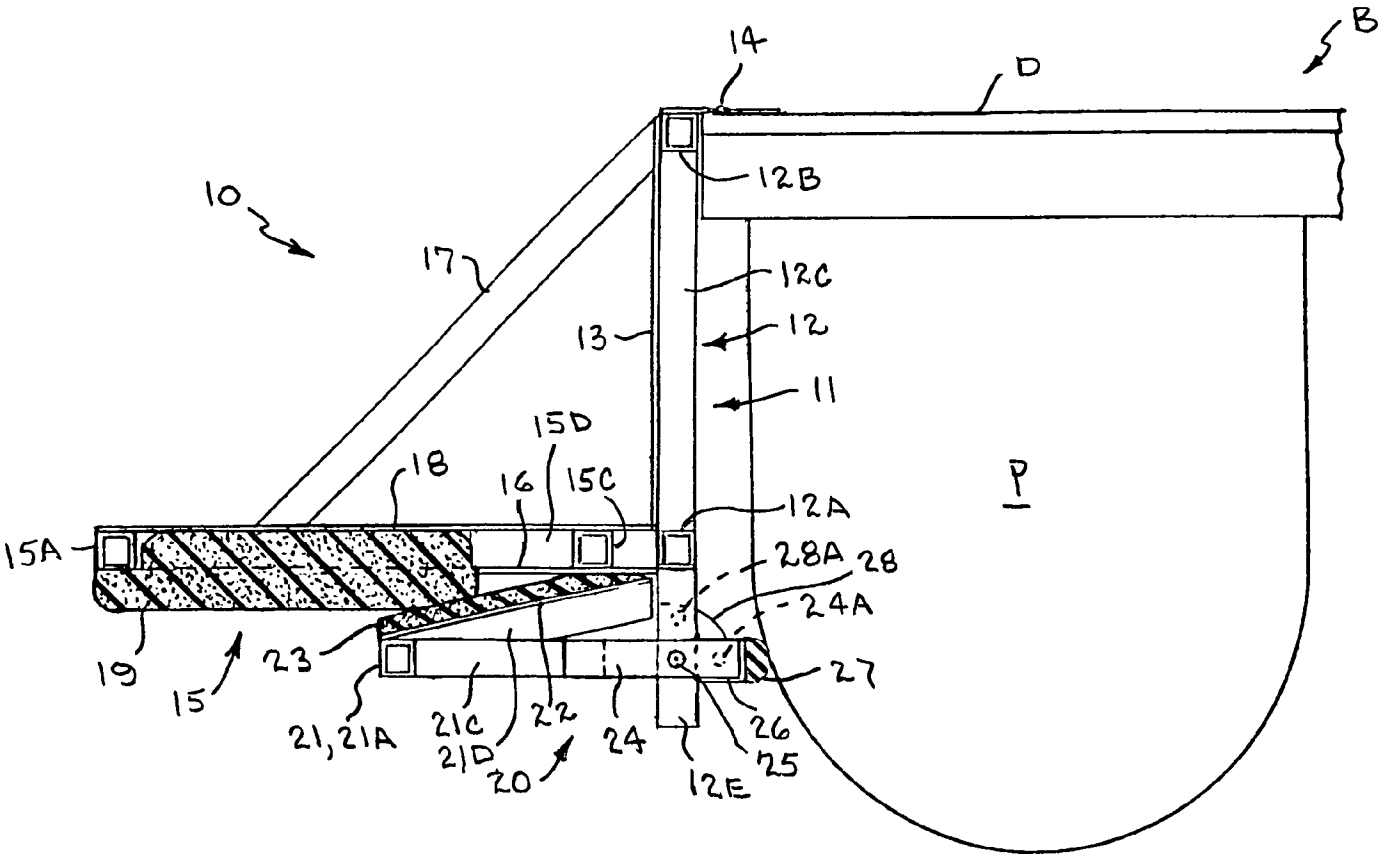

The seat frame 11 includes a generally rectangular horizontal frame component 15 having an elongate generally U-shaped outer tubular member 15A with a straight outer portion bent at each end to form opposed lateral side portions 15B which are secured at their ends to the side of the top longitudinal member 12A a short distance inwardly from the laterally opposed vertical end members 12C of the vertical frame component, and an elongate longitudinal cross member 15C that extends horizontally between the opposed lateral side portions 15B near their ends. A plurality of cross members 15D extend horizontally between the longitudinal cross member 15C and the outer portion of the generally U-shaped outer tubular member 15A. A relatively narrow generally rectangular panel 16 formed of rigid material is secured to the top sides of the top longitudinal member 12A and the longitudinal cross member 15C to extend therebetween. A plurality of seat pan support members 17 extend diagonally between the bottom longitudinal member 12B and the cross members 15D. As best seen in FIGS. 5A, 5B and 5C, a generally rectangular seat panel 18 formed of rigid material is secured to the underside of the longitudinal cross member 15C, the cross members 15D, and the generally U-shaped outer tubular member 15A to form a seat pan for receiving one or more seat cushions 19. As described hereinafter, the underside of the panel 18 forming the seat pan also serves as the platform support surface. The panels 16 and 18 and seat cushions 19 are not shown in FIG. 3, to more clearly show the show frame structure which would be obscured thereby.

The backrest frame 20 is formed by an elongate generally U-shaped upper tubular member 21 with a straight top portion 21A bent at each end to form opposed depending lateral side portions 21B. A first plurality of shorter vertical members 21C formed of rectangular tubing are secured at their top ends to the straight top portion 21A of the U-shaped tubular member 21 and extend vertically a relatively short distance therefrom in longitudinally spaced parallel relation. The shorter vertical members 21C of the backrest frame 20 are spaced apart approximately the same distance as the spaced apart shorter vertical members 12E of the seat frame vertical component 12, so as to be axially aligned therewith when the backrest frame 20 is in the upright position, as described hereinafter. A second plurality of shorter angular members 21D formed of rectangular tubing are secured at their top ends to the straight top portion 21A of the U-shaped tubular member 21 and extend angularly outward and downward a relatively short distance therefrom in longitudinally spaced parallel relation. The shorter angular members 21D of the backrest frame 20 are spaced apart approximately the same distance as the spaced apart shorter vertical members 21C of the backrest frame. A generally rectangular backrest panel 22 formed of rigid material is secured to the outer facing sides of the shorter angular members 21D for receiving one or more backrest cushions 23. The backrest panel 22 and backrest cushions 23 are not shown in FIG. 3, to more clearly show the show frame structure which would be obscured thereby.

As best seen in FIGS. 2A, 2B, 3, 5A, 5B and 5C, a plurality of relatively short pivot members 24 formed of rectangular tubing are each secured at their upper ends to the inner facing sides of the lateral side portions 21B of the U-shaped upper tubular member 21 of the backrest frame 20 and to one side of each of the shorter vertical members 21C of the backrest frame, respectively, such as by welding, and their bottom ends terminate a distance beyond the bottom ends of the shorter vertical members 21C. The lower portion of the short pivot members 24 are pivotally connected to the upstanding upper portion of the laterally opposed vertical end members 12C of the vertical seat frame component 12, and to the shorter vertical members 12E extending upwardly from the top longitudinal member 12A, by pivot pins 25 passing therethrough.

Figure 1B:
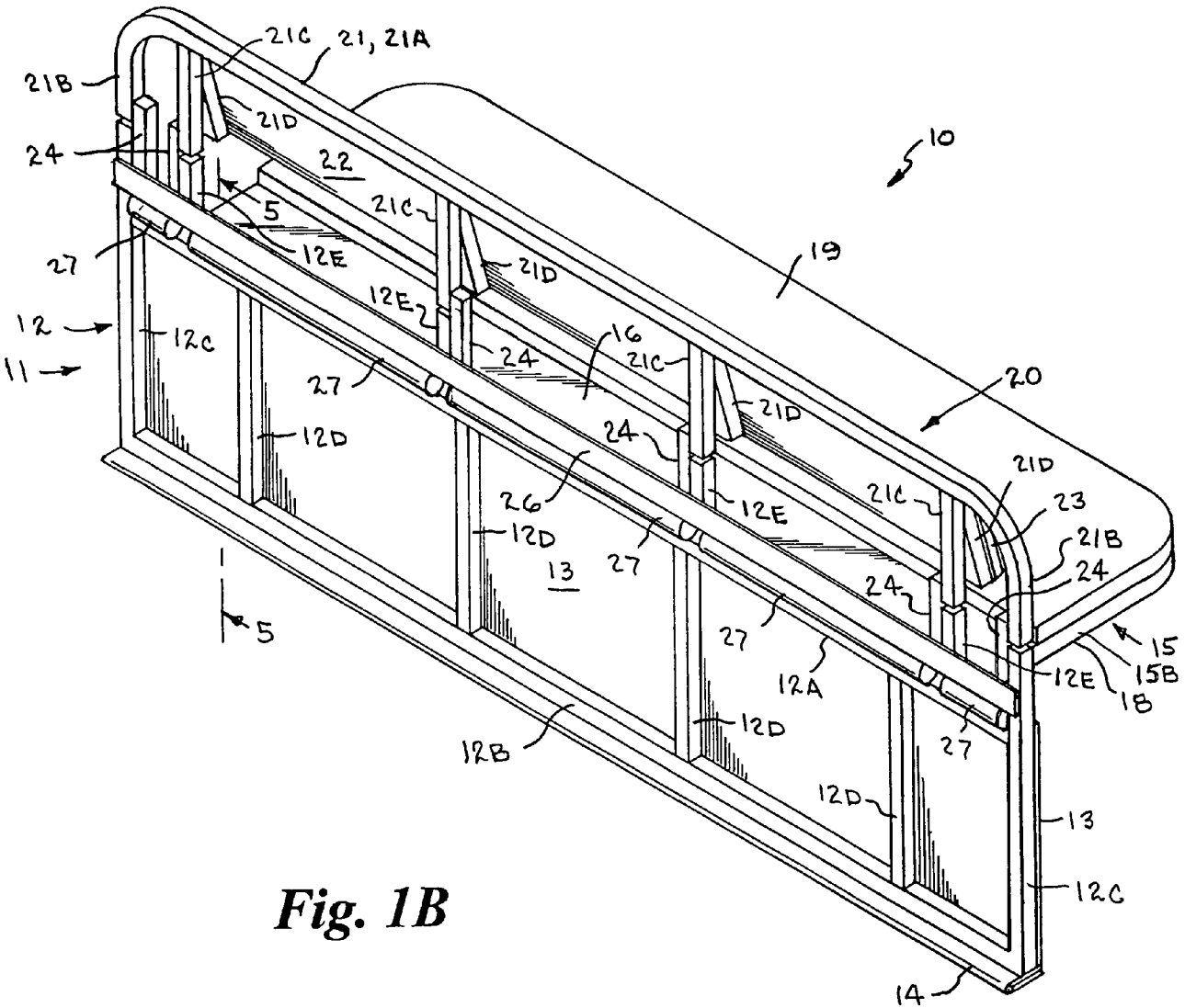
Figure 2A:
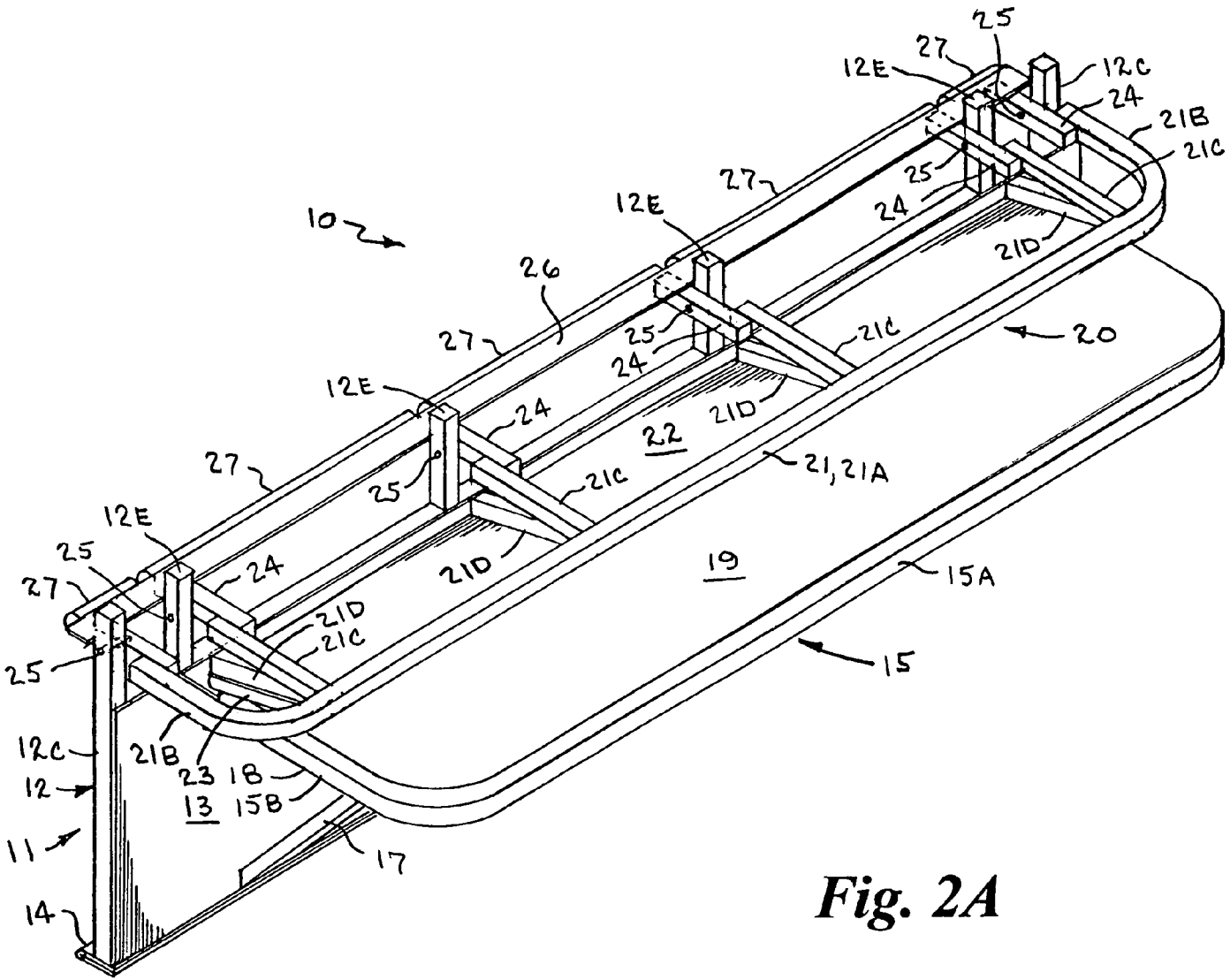
FIGS. 2A and 2B are isometric views, showing the convertible bench seat/platform apparatus with the backrest in a collapsed folded position, shown from the front and back, respectively.
Figure 2B:
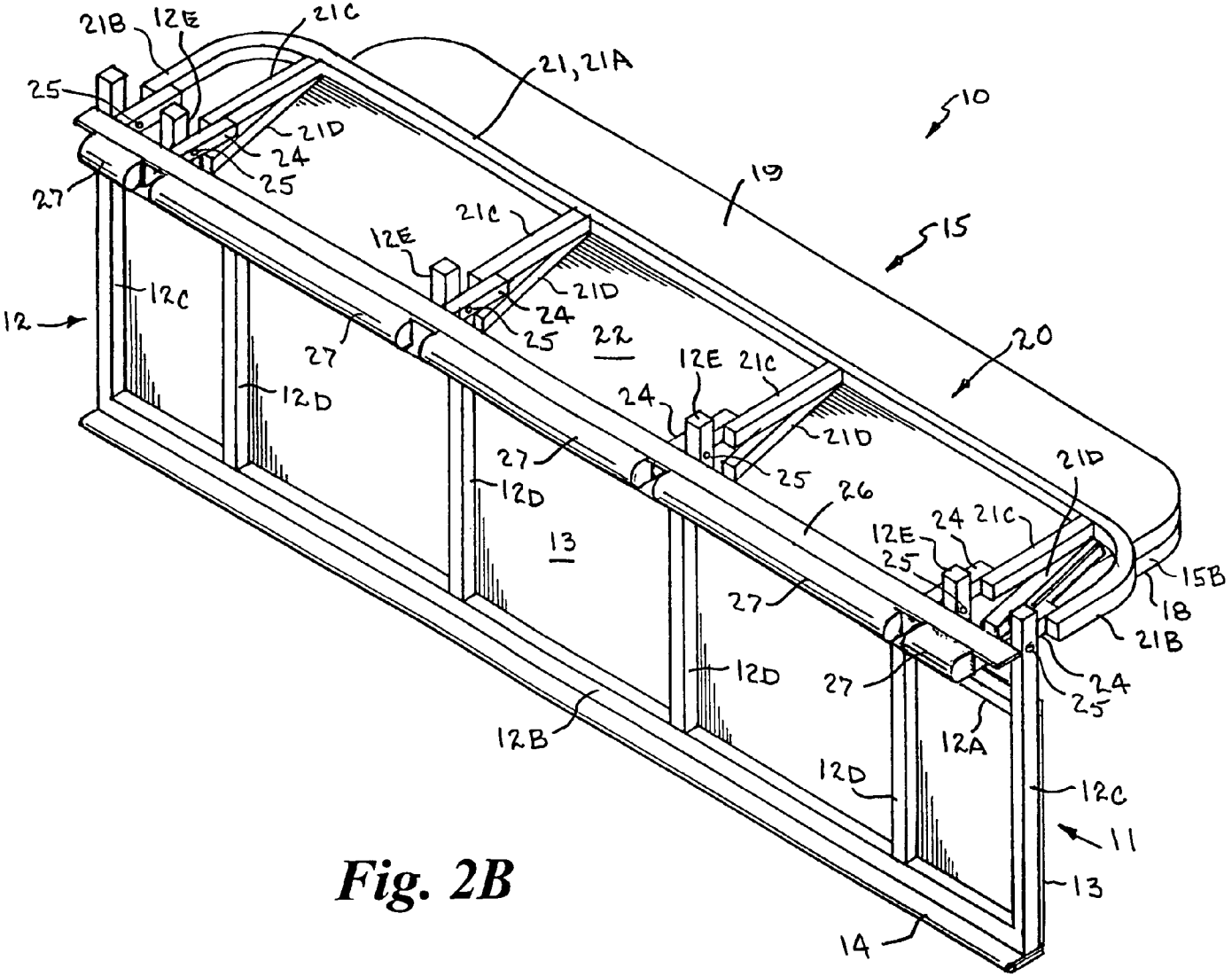
Figure 3:
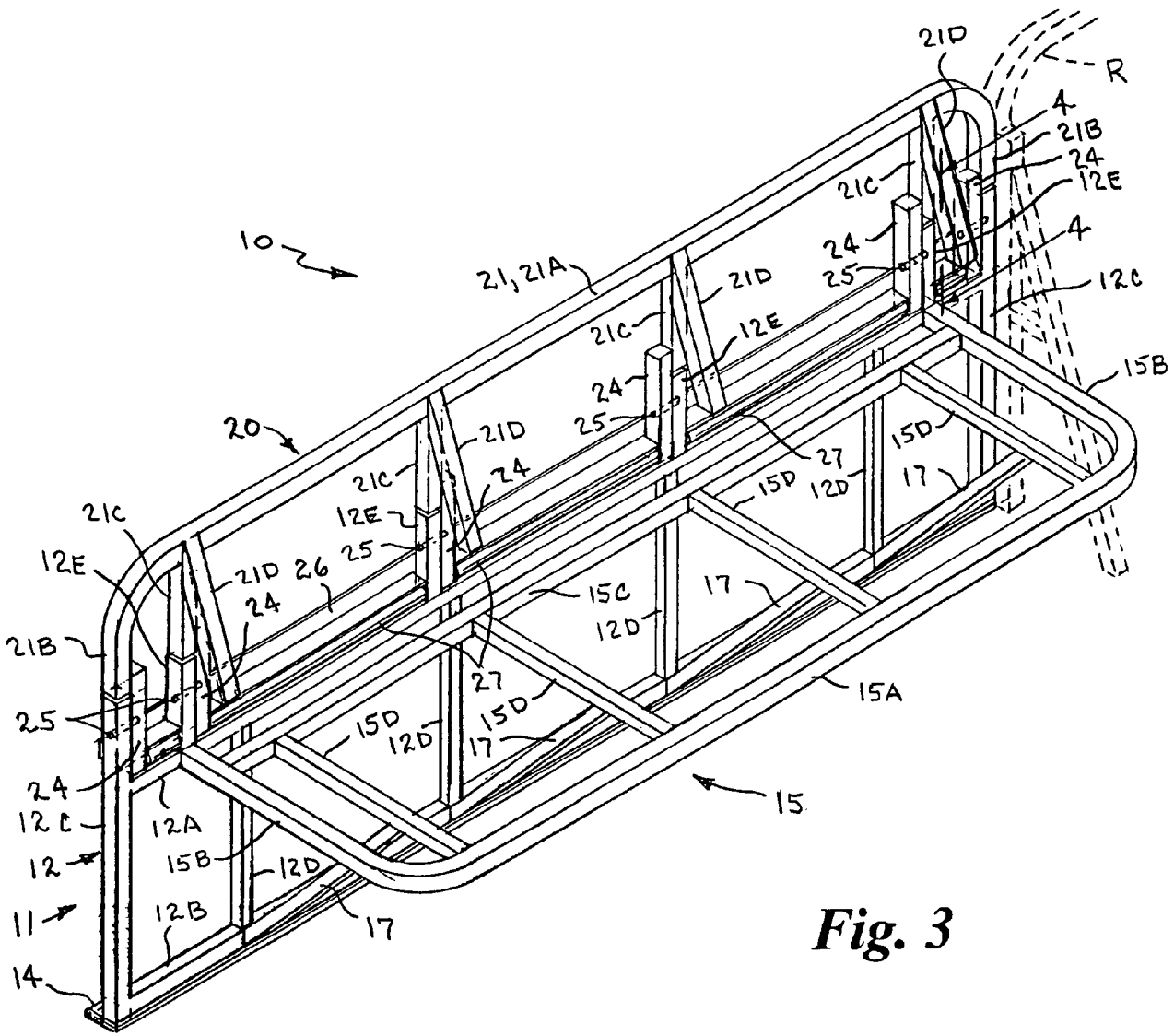
FIG. 3 is an isometric view of the convertible bench seat/platform apparatus shown from the front with the backrest panel, the seat panel, and the cushions removed, to more clearly show the frame structure.

As best seen in FIGS. 1B, 2A, 2B, 3, 5A, 5B and 5C, an elongate angle member 26 is secured to the bottom ends of the pivot members 24, and an elongate bumper member 27 formed of a suitable resilient or elastomeric material is secured to the outer facing surface of the angle member. As best seen in FIGS. 1B and 2B, one leg of the angle member 26 is cut away and the bumper member 27 is segmented to provide longitudinally spaced openings which straddle the shorter vertical members 12E that extend upwardly from the top longitudinal member 12A of the vertical component 12 of the seat frame 11, when the backrest frame 20 is in an upright position. As described hereinafter, when the backrest frame 20 is pivoted to assume a folded position, the bottom ends of the pivot members 24, and elongate bumper member 27 are disposed outwardly from the rear of the seat frame 11.

Figure 4A:
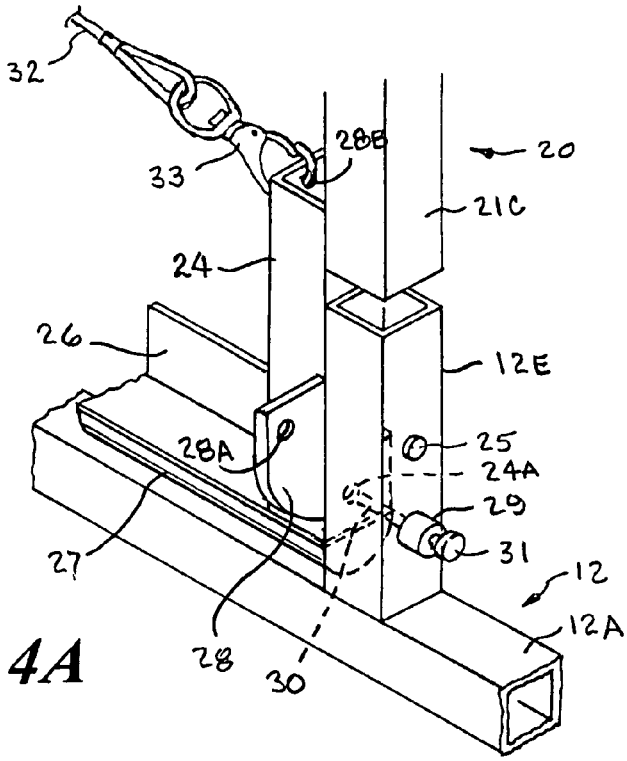
FIGS. 4A and 4B are partial isometric views, taken along line 4-4 of FIG. 3, showing the details of a latching mechanism, with the backrest latched in the upright raised position and in the collapsed folded position, respectively.
Figure 4B:
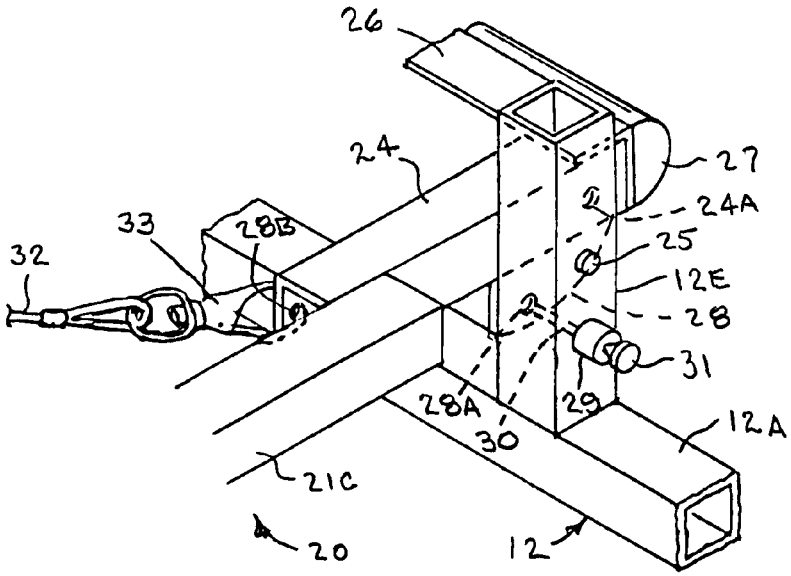

FIGS. 4A and 4B show a portion of the top longitudinal member 12A of the vertical component of the seat frame 12, a shorter vertical member 12E that extends upwardly therefrom, a pivot member 12 pivotally connected thereto, and secured to the side of a shorter vertical member 21C of the backrest frame 20. A flat arcuate latch plate 28 is secured to the inner facing side of one of the pivot members 24 and its flat surface is flush with the adjacent side of the pivot member that is pivotally connected to the vertical member 12E. The latch plate 28 and the pivot member 24 are each provided with a hole 28A and 24A, respectively, that are radially spaced from the pivot connection 25 and approximately 90° apart. A latch mechanism 29 is secured to an outer facing side of the shorter vertical member 12E and has a retractable spring biased plunger 30 that extends through aligned holes in the vertical member 12E and is received in either of the hole 28A in the latch plate 28 or the hole 24A in the side of the pivot member 24. As seen in FIG. 4A, the plunger 30 is received in the hole 28A in the side of the pivot member 24 when the backrest frame 20 is in the upright position; and is received in the hole 28A in the latch plate 28 when the backrest frame is in the folded position. The latch mechanism 29 has a manual knob 31 on the outer end of the plunger 30 which is gripped by the operator and pulled outwardly to move the backrest frame 20 between the upright and folded positions and released to latch the backrest frame in the desired position. Such latching mechanisms are conventional and well known in the art, and therefore not shown in detail.

Figure 6A:
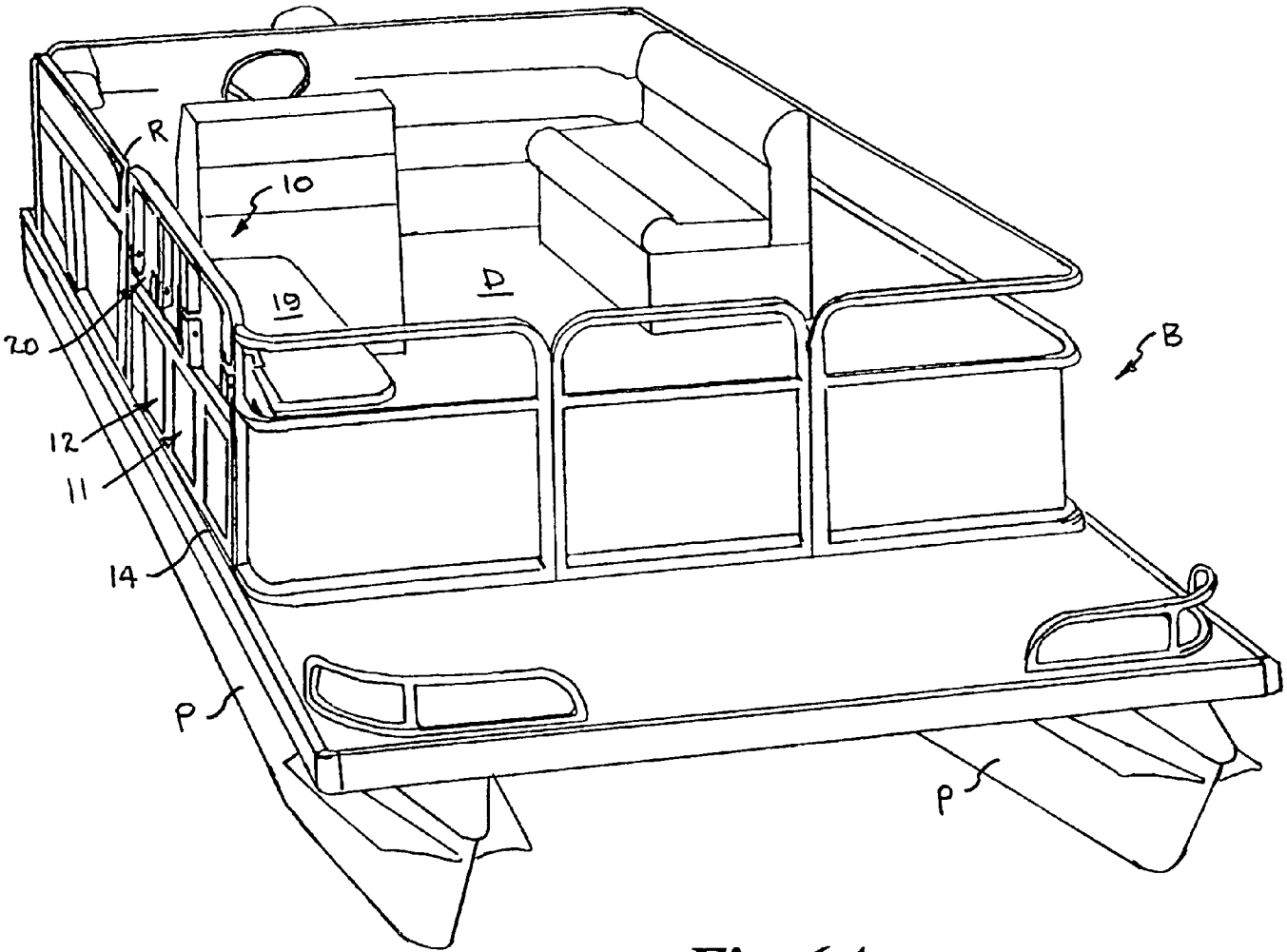
FIGS. 6A, 6B, 6C and 6D are perspective views of the convertible bench seat/platform apparatus mounted on a pontoon boat adjacent to the side rail of the boat, shown with the backrest in the upright position, the folded position, the whole assembly in a partially pivoted position, and the whole assembly pivoted over the side of the deck to serve as a platform, respectively.
Figure 6B:
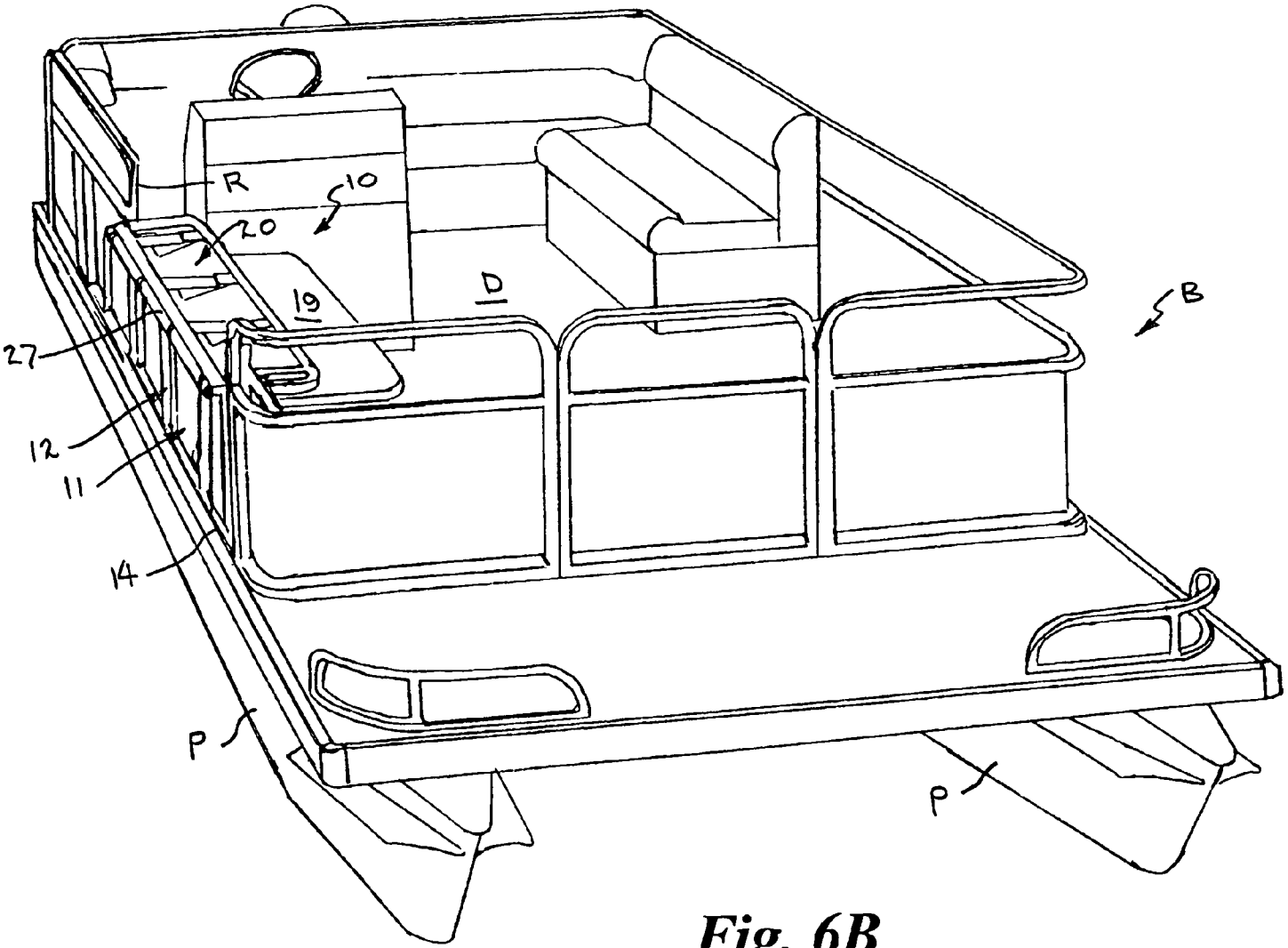
Figure 6C:
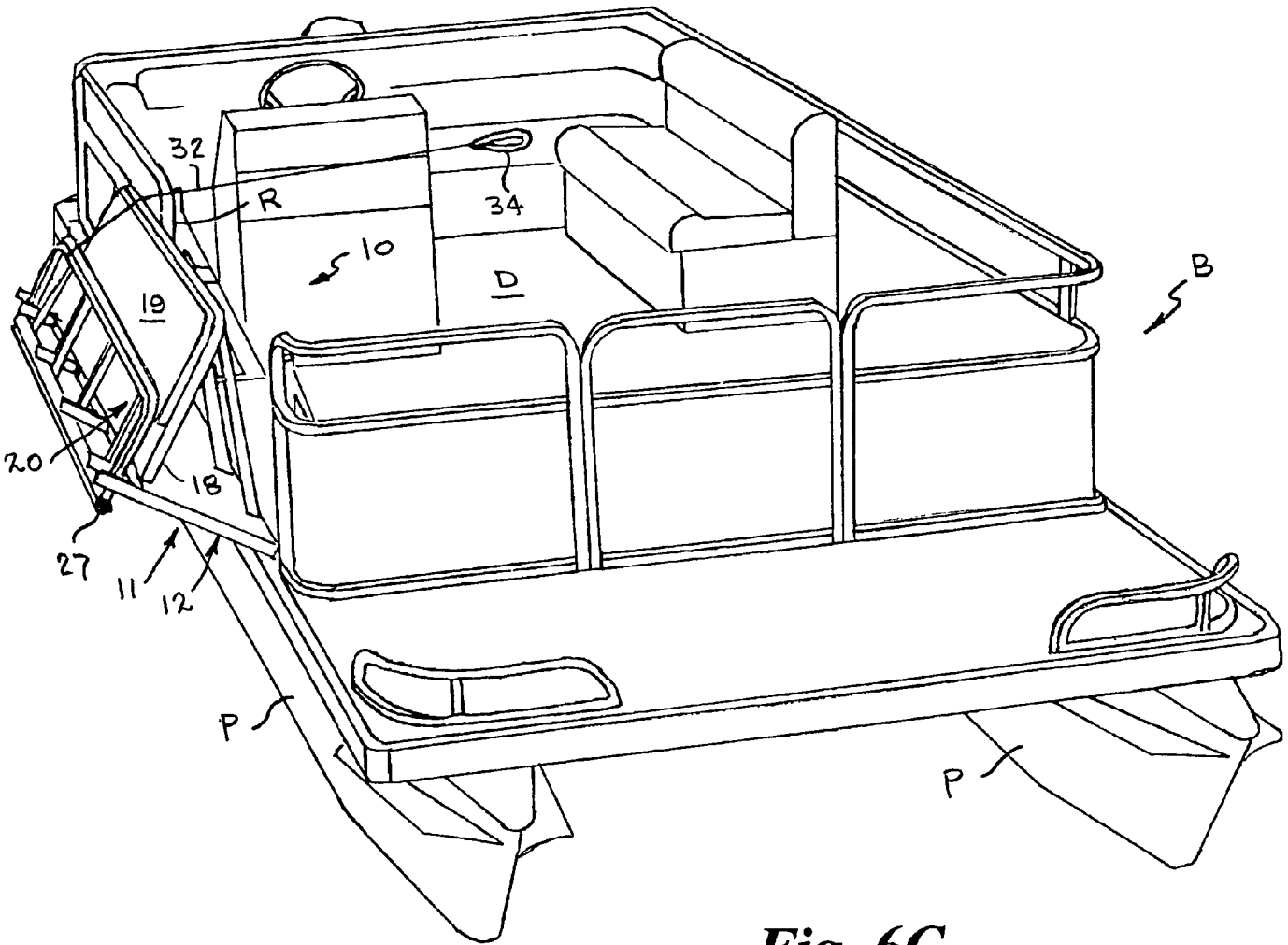
Figure 6D:
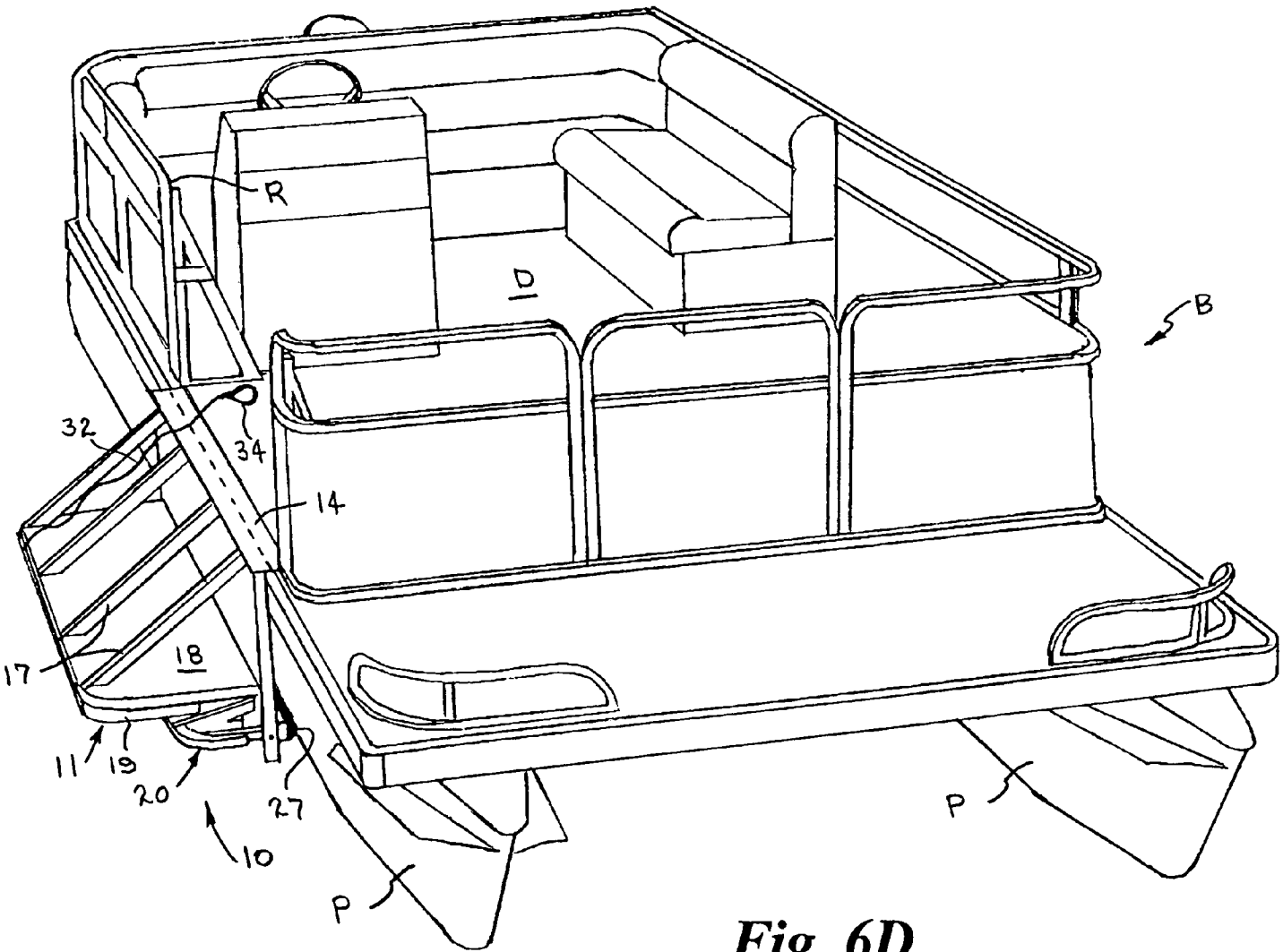

Also, shown in FIGS. 4A and 4B, is a portion of a lifting cord 32 which may be secured at one end to the seat assembly 10, for example, by a attaching a conventional fastener, such as a swivel eye spring snap 33, to one end of the cord and passing it through a hole 24B in the side of one of the pivot members 24, or by passing the cord through the hole and tying it in a knot. The opposed free end of the lifting cord 32 is provided with a looped hand grip 34, as seen in FIGS. 6C and 6D. The lifting cord 32 is used to facilitate lowering the seat assembly to the outboard position and raising it to the inboard position by a person standing on the deck.

In a preferred embodiment, the seat cushion(s) 19 and backrest cushion(s) 23 are thermoformed of closed-cell foam material that does not absorb water. Thus, the seat cushion(s) may be secured to the rectangular seat panel 18 and the backrest cushion(s) 23 may be secured to the rectangular backrest panel 22, by a suitable waterproof marine adhesive and left in place even when submerged in the water. Alternatively, they may be removably secured to the panels 18 and 22 by conventional fasteners.

Referring now additionally to FIGS. 5A, 5B, 5C; FIGS. 6A, 6B, 6C and 6D; and FIGS. 7A, 7B, 7C, and 7D; the convertible bench seat/platform apparatus 10 is hingedly mounted on the deck D of the pontoon boat B by securing the second leg of the elongate hinge member 14 at the bottom of the vertical component 12 of the seat frame 11 to the boat deck closely adjacent to the side of the deck such that the vertical seat frame component 12 and backrest frame 20 in a vertical position are aligned with the side rail R of the boat and the horizontal seat frame component 15 facing inward (inboard) relative to the railing.

In the inboard position, with the backrest 20 in the upright latched position (FIGS. 5A, 6A. 7A), the bench seat/platform apparatus 10 can be use as a bench seat for sitting or sleeping. In the inboard position, the backrest 20 may also be latched in a folded position (FIGS. 5B and 6B). When the backrest 20 is pivoted to assume the folded position, the bottom ends of the pivot members 24, and elongate segmented bumper member 27 are disposed outwardly from the rear of the seat frame 11. The bench seat/platform apparatus 10, with the backrest 20 latched in the folded position can be pivoted as a unit about the hinge 14 between the inboard position adjacent to the boat side rail R to an outboard position (FIG. 5C, 6C, 6D). As described above, the lifting cord 32 secured at one end to the seat assembly facilitates lowering it to the outboard position and raising it to the inboard position by a person standing on the deck.

Figure 7A:
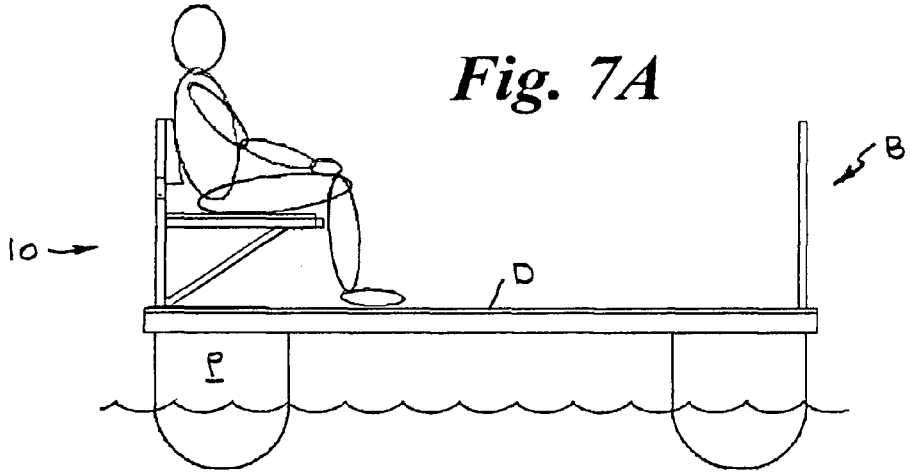
FIGS. 7A, 7B, 7C, and 7D are schematic side elevational views showing the convertible bench seat/platform in use as a bench seat, as an outboard seating platform, as a diving platform, and as a platform for supporting the feet of a person seated on the deck of a boat, respectively.
Figure 7B:
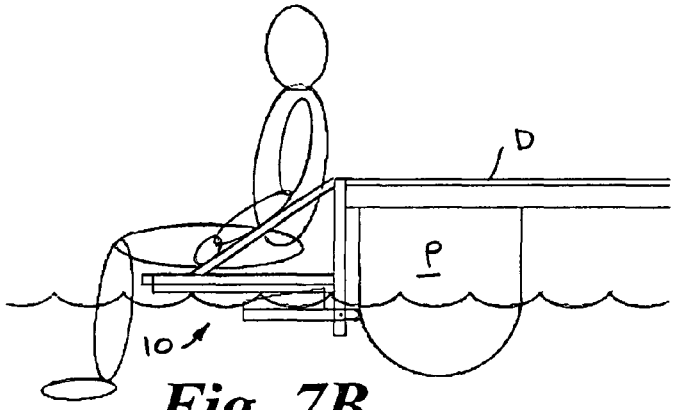
Figure 7C:
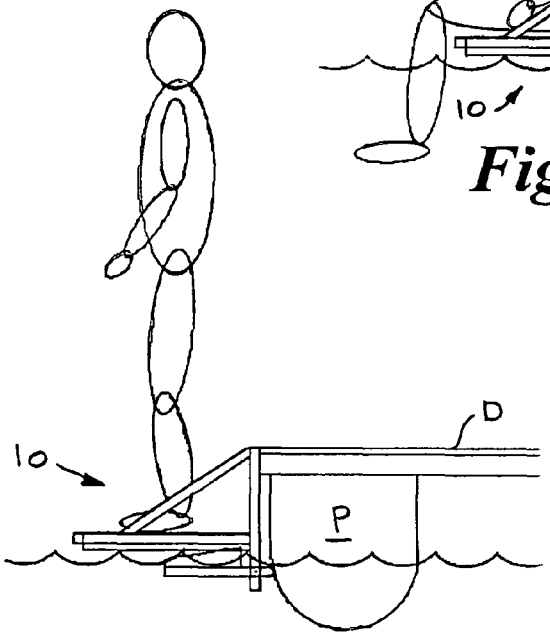
Figure 7D:
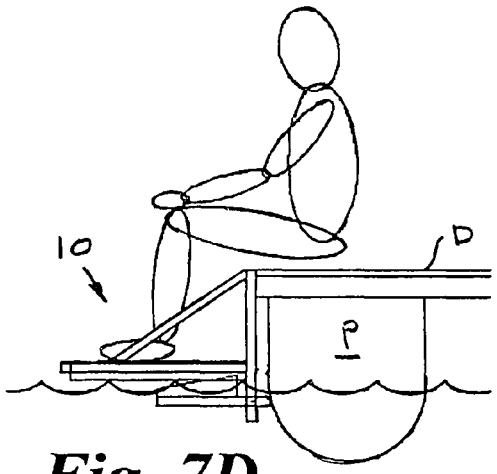

When pivoted to the outboard position, with the backrest 20 in the latched folded position, the bench seat/platform apparatus 10 is in an inverted position to serve as a platform, the elongate segmented bumper member 27 is engaged on the side of the pontoon P, and the underside of the seat panel 18 forming the seat pan serves as the platform support surface (FIGS. 5C, 6C), and the platform can be used as an outboard seating platform (FIG. 7B), as a diving platform (FIG. 7C), and as a platform for supporting the feet of a person seated on the deck of the boat (FIG. 7D). The backrest 20 is pivotally connected at a point such that when folded and in the outboard position, it will not extend below the bottom of the pontoon to prevent it from contacting the sand when the boat is beached.

In the outboard position, the bumper member 27 engaged on the exterior of the pontoon P maintains the vertical seat component 12 of the seat frame 11 in a generally vertical position at the side of the boat B and the horizontal component 15 of the seat frame in a generally horizontal position. The diagonal seat support members 17 may serve as arm rests, or as hand grips for climbing onto the platform and/or entry to or egress from the deck.

In a preferred embodiment, the bench seat/platform apparatus 10 is approximately 7 feet in length to keep weight down yet still provide a seating surface of sufficient length to accommodate several people sitting side-by-side or a single person laying down in a supine position. Also in a preferred embodiment, the height of the seat frame assembly 111 is such that the top of the backrest frame 20 in a vertical position is aligned with the top rail of the boat railing R. The convertible bench seat/platform of the present invention can replace a section of the railing of a pontoon boat or some other styles of deck boats.

Although described with reference to a pontoon boat, the convertible bench seat/platform 10 of the present invention is adaptable to various other types of watercraft, other moveable platforms, and can be used on various water craft for search and rescue operations.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A convertible bench seat/platform for installation on a deck of a boat and movable between an inboard position adjacent to a side of the deck for use as a bench seat and an inverted outboard position for use as a platform, comprising;

a frame assembly including a seat frame and a backrest frame;

said seat frame comprising a generally rectangular vertical frame component with parallel spaced longitudinal top and bottom ends and laterally opposed ends, and a generally rectangular horizontal frame component extending outwardly from said vertical frame component defining a seat pan for receiving one or more seat cushions;

said backrest frame comprising a generally rectangular upper frame component for receiving one or more backrest cushions, said backrest frame pivotally connected with said vertical frame component of said seat frame to pivot relative thereto between an upright position and a folded position disposed over said seat pan; and a hinge member having a first leg secured to said longitudinal bottom end of said seat frame vertical frame component, and a second leg adapted to be secured to the deck of the boat closely adjacent to a side of the deck to allow pivotal movement of said seat frame assembly as a unit between an inboard position on the boat adjacent to the side of the deck for use as a bench seat and an inverted outboard position for use as a platform.

2. The convertible bench seat/platform according to claim 1, wherein the boat has a side rail along at least one side of the deck; and in said inboard position, said vertical frame component of said seat frame and said upper frame component of said backrest frame in the upright position is generally aligned with the side rail, and said seat pan is disposed generally horizontally inward relative to the side rail; and in said inverted outboard position, said seat pan is disposed generally horizontally outward from a side of the boat.

3. The convertible bench seat/platform according to claim 1, further comprising:

bumper means extending longitudinally along a backside of said frame assembly for engaging a deck supporting portion of the boat body that rests in the water, said bumper means being engaged when said seat frame assembly is pivoted as a unit to said inverted outboard position to maintain said vertical frame component of said seat frame in a generally vertical position at the side of the boat and said seat pan in a generally horizontal position outward from the side of the boat.

4. The convertible bench seat/platform according to claim 1, further comprising:

one or more seat cushions on a top surface of said seat pan, and one or more backrest cushions on said upper frame component of said backrest frame.

5. The convertible bench seat/platform according to claim 1, further comprising:

latch means interfaced with said seat frame and said backrest frame for releasably latching said backrest frame in said upright position and in said folded position disposed over said seat pan.

6. The convertible bench seat/platform according to claim 1, further comprising:

a lifting cord secured at one end to said seat assembly and having a free end to be gripped by a person on the deck to facilitate lowering of said seat assembly to said outboard position and raising it to said inboard position.

7. The convertible bench seat/platform according to claim 1, wherein said seat frame generally rectangular vertical frame component is constructed of a parallel spaced top and bottom longitudinal tubular member and laterally opposed vertical tubular end members with tubular cross members extending vertically between said top and bottom members in longitudinally spaced parallel relation, and a generally rectangular flat panel formed of rigid material secured to one side of said vertical frame component.

8. The convertible bench seat/platform according to claim 7, wherein said seat frame generally rectangular horizontal frame component is constructed of a generally U-shaped tubular member having an elongate longitudinal outer side portion and opposed lateral side portions secured at their ends to said seat frame vertical frame component, a plurality of tubular cross members extending horizontally therebetween, and a generally rectangular flat panel formed of rigid material secured to one side of said horizontal frame component defining said seat pan; and a plurality of spaced apart tubular seat support members secured at a first end to said bottom longitudinal tubular member of said seat frame vertical frame component and at a second end to said seat frame horizontal frame component.

* * * * *